United States Patent [19]

Lazcano-Navarro et al.

[11] Patent Number: 4,606,531

[45] Date of Patent: Aug. 19, 1986

[54] ROTARY JOINT APPARATUS FOR INTRODUCING AND TRANSPORTING SEVERAL INDEPENDENT FLUIDS AND SOLID FINES INTO A METALLURGICAL CONVERTER

[75] Inventors: Arturo Lazcano-Navarro; Miguel A. Alcantara, both of Saltillo, Mexico

[73] Assignee: Instituto Mexicano de Investigaciones Siderurgicas, Saltillo, Mexico

[21] Appl. No.: 642,254

[22] Filed: Aug. 20, 1984

[51] Int. Cl.[4] ..... C21C 7/00

[52] U.S. Cl. ..... 266/216; 266/245

[58] Field of Search ..... 266/216, 271, 243, 245, 266/246, 247; 137/615, 798; 406/128; 173/39

[56] References Cited

U.S. PATENT DOCUMENTS

| | | | |
|---|---|---|---|
| 4,055,335 | 10/1977 | Fisher | 266/245 |
| 4,284,266 | 8/1981 | Nagati | 266/246 |
| 4,325,540 | 4/1982 | Seki et al. | 266/243 |
| 4,428,564 | 1/1984 | Nagati | 266/246 |
| 4,497,379 | 2/1985 | Mailliet et al. | 266/271 |

*Primary Examiner*—L. Dewayne Rutledge
*Assistant Examiner*—S. Kastler
*Attorney, Agent, or Firm*—Laurence R. Brown

[57] ABSTRACT

This invention relates to a rotary joint for introducing a plurality of different separated fluids from a first static system, to a second system that is rotating with respect to the first, namely for passing fluids and solid fines carried in fluids into a rotatable iron converter through rotary trunnion couplings. The separated different fluids are passed simultaneously through a stationary cylindrical sleeve surrounding a rotating core shaft coupled to the trunnion. Conduits housed in such stationary sleeve pass the fluids to separate circumferential channels axially located along the rotating shaft from which a set of independent lines transporting fluids axially through the trunnion which is rotating with respect to the receiving static sleeve. Between the separate channels in the rotating shaft there are seals that do not permit the passage of a fluid from a given channel conduit into any other. This makes the conduction of fluids in the lines and/or channels independent of each other.

1 Claim, 2 Drawing Figures

ROTARY JOINT APPARATUS FOR INTRODUCING AND TRANSPORTING SEVERAL INDEPENDENT FLUIDS AND SOLID FINES INTO A METALLURGICAL CONVERTER

BACKGROUND OF THE INVENTION

In many instances, when several fluids usually not more than three, have to flow from a given static system into a rotating system in a separate and independent way, a conventional apparatus called rotary joint is used. This mechanism permits the passage of fluids at high speed rotation and normally a rotary joint transports the fluid at relative high pressure. The most common joint is for only one single fluid.

When the speed of rotation is not high, other devices called swivel joints are used.

All of them fail in transporting fluids in several independent and separated lines from a given static system to a rotating system.

In very special applications, some times it is necessary to transport solid powder in a carrier gas from a static system into a rotating one.

A conventional well made rotary joint will not be able to sustain such a condition with solid fines suspended in a high pressure gas, said solid fines transportation in a certain condition requires high pressure and pressure drop in a fluid line with gas fines phase is high.

This condition is detrimental for the seal mechanisms in a conventional rotary joint as the fine powder will stick within interfaces between sealing elements and rotating elements.

A more special and specific case of stringent requirements for transporting fluids from static to rotating system is when separated gases from several independent lines or/and also parallel solid suspended fines lines must go from the static system into a rotating system. Thus, the complete scheme of requirements of the rotating system for introducing the fluids and fines becomes more complex.

For instance, in the case of a furnace converter for making steel, when oxygen, other gases like propane and solid fines i.e. lime, must go simultaneously into a converter that is tilted several times during the process, very stringent conditions for separated transport of fluids and solids into the rotating converter system result.

For these cases within the context of the iron and steel making industry and particularly when transporting gases and solids into a converter for injections in the liquid bath i.e. the case of Q÷BOP type process, rotary joints and combinations of special and commercial rotary joints have been developed for specific fluids transport and specific conditions.

In the case of the present invention a principle for a multi-fluid and solids transport is presented with improvement in simplicity of design and construction. Easy maintenance is inherent due to the assembly design and simplicity of parts.

SUMMARY OF THE INVENTION

The apparatus of the present invention has been conceived for its application in the introduction of oxygen and other gases or liquids and solids with transporting gas into a converter furnace for the treatment of liquid metal, particularly in the refining of pig iron and smelting of iron bearing solids.

These fluids and gas transporting solids are injected into the liquid metal, through tuyeres located in the bottoms of such converters.

More specifically, the systems for which the mechanism of this invention is devoted comprise a furnace converter with basic lining material that contains during the process, liquid iron bearing metal to which different gases and solids are injected, for instance oxygen, nitrogen, propane, air, carbon dioxide and possibly some other gases serving as phneumatic transport for solids in form of fines. The injection of fluids and solids into the liquid bath has a great metallurgical advantage, for example the possibility of injecting lime fines resulting in a much better slag forming evolution compared to the classical way of introducing lump lime through the mouth of the converter when refining pig iron for making steel in a Basic Oxygen Furnace process.

In this bottom injection system it is also possible for instance to inject in the same way, fines of carbon in less than 0.3 mm size through tuyeres located in the bottom of the furnace. This injection of carbon for instance, provides external energy to the system and makes it more flexible in terms of heat input requirements, for example for increasing the capacity of melting iron bearing solids by the combustion of the extra carbon input through the bottom tuyeres into the bath.

This is important because it creates flexibility in the thermal balance of the process which in practical terms results in the possibility of controlling the hot metal to cold metal charge ratio into the converter.

The injection of several fluids and/or fluids with solid fines into the converter in a simultaneous and continuous way must be accomplished, in order to allow the continuous injection into the converter, even when the converter is rotating. For instance, a complete cycle of the process of refining the hot metal and melting the cold iron bearing solids charged in the converter, includes steps of charging, sampling, tapping, and deslagging. This in turns implies the tilting of the converter with the necessity of a simultaneous and continuous introduction of fluids into the converter.

This condition results in the necessity of a mechanism for permitting the introduction of several different fluids for injection when the converter is rotating.

It is therefor a primary object of the present invention to provide apparatus for passing into the converter several different fluids and one solid material in form of fines from a set of static conduction lines located in the vicinity of a rotating system i.e. a converter of the basic oxygen type for treating molten metal, continuously and simultaneously at any stage of the process, particularly when the converter is tilting.

This apparatus for transporting a set of different fluids from a static set of conduction lines into a set of rotary conduit lines housed in a rotating system can be applied to a number of different processes under certain and very particular conditions.

DESCRIPTION OF THE DRAWINGS

FIG. 1 also shows the location of the mechanism in the trunnions of the converter that receives the static conduction lines (static system) and conveys the fluid into the rotating trunnion lines and from the trunnion to the bottom tuyeres.

DESCRIPTION OF THE PREFERRED EMBODIMENT

Figure 1:
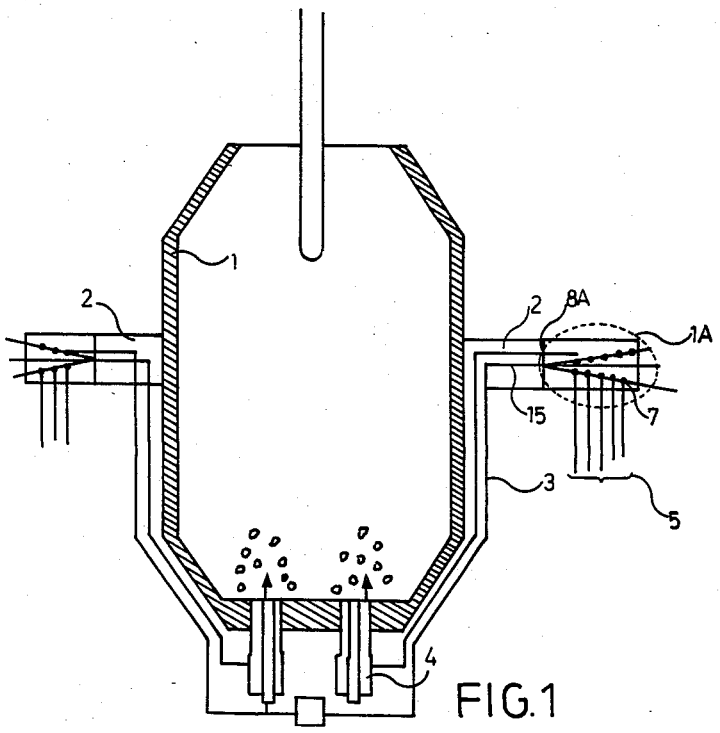
FIG. 1 shows a schematic view of the converter vessel as an example of a rotating system to which fluids and solid particles are injected into the molten metal contained in such converter.

FIG. 1 of the drawings shows the rotating system in our preferred embodiment, comprising the converter vessel (1), the trunnions (2), the piping (3) and bottom tuyeres (4). In the outer ends of the trunnion (8A), the rotary joint mechanism (1 A) is located for receiving a set of incoming pipe lines (5) connected to a fixed sleeve (7) which connects conduits to rotary shaft channels.

Figure 2:
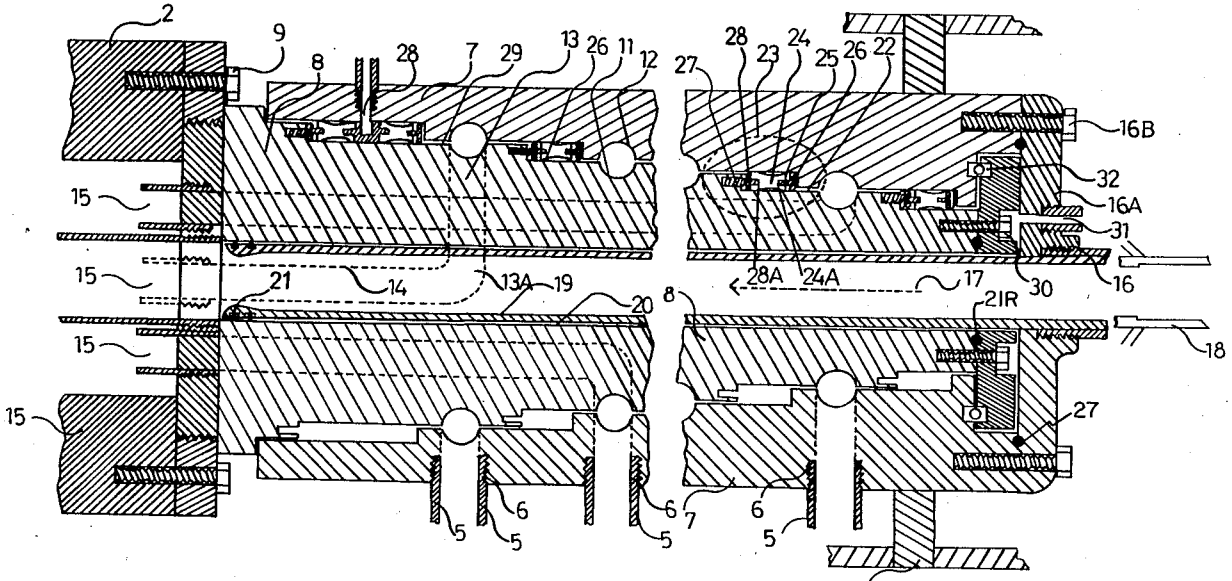
FIG. 2 shows an enlarged longitudinal elevational cross sectional view of the rotating shaft with the moving channels, housed in the static sleeve, also showing the configuration of the sealing system between shaft and sleeve.

According to FIG. 2, which describes in detail the apparatus of this invention, a set (more than 2) of pipe lines (5) for conducting gases connect a corresponding set of ports (6) located in a fixed sleeve (7) with fluid flow direction initially perpendicular to the axis of the sleeve (7) and trunnion (2).

The sleeve (7) envelops shaft (8) which rotates with converter tilting and it is fixed to the trunnion (2) by screws (9). The sleeve (7) is anchored to an external fixed structure (10), independent of the converter tilting system.

The shaft (8) attached to the end of the trunnion (2) rotates with the converter and has circumferential furrows or channels (11), namely half circles in section or other shape, machined about the circumference of the shaft (8). Both channels (11) and complete a circle section, namely the half circle channel (11) around the external circumference of the shaft, and half circle channel (12) around the internal circumference of the sleeve (7).

Each channel (12) of complete circle section (11) has a fixed port (6) for entering of the fluid through the fixed sleeve (7), and is also connected to a rotating fluid exit port (13) in the rotating shaft (8).

From rotating port (13), follows a bending conduct (13 A) inside the shaft (8), and then a straight part conduit (14) also in the shaft (8), connecting the fluid to the rest of the rotating piping system (15) that finally conveys the fluids to the bottom tuyeres.

Thus, a fluid flowing from the static outside line pipe system (5) to the converter rotating system (15) goes through the following path: The fluid enters ports (6) in sleeve (7) from static line pipe (5). Then the fluid flows to the channel ring (11-12) and enters in shaft port (13). As the shaft (8) rotates and therefore shaft port (13) also rotates, the fluid passes from the static system in the sleeve (7) to the rotating system in the shaft, from which fluid is conducted to the rest of the converter pipe system (15) and bottom tuyeres (4, FIG. 1).

Another conduit (16) for passing a fluid or a fluid carring solids in form of fines from the static to the rotating system, enters across the center and along the axis space (17) of the rotary joint apparatus. In this case the conduction line need be bigger than this passing through the center of the shaft, there is in principle no limitation in diameter.

Because in this central line (17) there is not one single bend, as in the case of the circumferential channeled lines (11-12), because of the larger size of line (17), and because the sealing mechanism of tube (19) is simpler and safer as explained below, it is possible to pneumatically convey solid fines from the static hose (18) through the central port (16) to the rotating shaft (8), and then to the rest of the rotating system (15).

The hose (18) connects to the port (16) which is bored in a plate (16A) also static as it is screwed (16B) to static sleeve (7). From port (16) a continued and static tube (19) goes through center bore (20) of the rotating shaft. So the tube (19) is static and center shaft bore (20) rotates as the converter is tilted, the seal between repose tube (19) and center shaft bore (20) is formed by sealing 0-rings or a proper sealing ring (21). Also the dynamics of the fluid in the exit of tube (19) decreases static pressure between tube (19) and bore (20) due to the contraction of the fluid jet when leaving tube (19).

The number of independent conduction lines from the static system to the tilting or rotating system (1, 2, 3, 4, FIG. 1) depend on each application and dictate the number of furrows or channels made in the shaft and sleeve. From FIG. 2, it is clear that when increasing the total number of conduction lines, the length of the rotary joint apparatus also increases.

In our preferred embodiment of a converter for treating liquid metal we can attach one rotary joint apparatus to the end (8A) of each trunnion (2) and handle several gases through the sleeve's ports (6) and solid fines through central port (16). For instance, at a given moment during the process of blow through bottom tuyeres it should be necessary to inject oxygen through a number of central bottom tuyeres; oxygen and lime through another set of bottom tuyeres, and propane through annular tuyeres located around each and every tuyere.

In this case a central conduit line (16, 19, 20) of the rotary apparatus mounted in middle trunnion conducts oxygen and lime to the central tube that rotates (when the converter is tilted) with the rotatable piping system (15) and from there to be corresponding bottom tuyeres for injection. The pure oxygen without lime will enter through ports (6) in sleeve (7) and flow by channel (11-12) to the rotating shaft (8) and system (15), and then to a corresponding tuyere or set of tuyeres for pure oxygen injection. Finally, the propane will be introduced by a rotary apparatus located on the other side of the converters trunnion, where propane gas is introduced through ports (6) and follows in separated lines, the same path as described for pure oxygen, but in this case, propane is conducted in system (15) of the other side (drive) trunnion for conducting propane to annular tuyeres around each oxygen and oxygen/lime tuyere.

A key point in this rotary apparatus is the sealing mechanism that makes the conduction lines independent of each other.

As can be seen from FIG. 2 lines (5) arrive in sleeve (7) independent of each other and stays that way through port (6) until the flow reaches conduct rings formed by channels (11-12). Within these rings the fluid with a certain pressure will tend to leak through slits (22) formed by the cyclindrical interface between static sleeve (7) and rotable shaft (8).

In order to avoid any flow of fluid from a given conduit ring (11-12), into a neighbour conduit ring (11,12), a sealing mechanism (23) between each conduct ring (11-12) is provided.

This mechanism (23) consist of a seal ring (24) shaped to seal by deformation when the whole apparatus is ensembled; that is when the sleeve (7) is mounted encasing the shaft (8), which is all ready attached to trunnion (2) by screws (9). Thus the seal is performed in two interface locations: One by the intimate contact (25) between seal ring (24) and interior part of sleeve (7), and by contact (26) between seal ring (2) and the cylindrical periphery of shaft (8) within a box specially prepared for housing the sealing mechanism (23).

The mechanism (23) also provides an improvement for tighter contacts (25) and (26) by means of a back pressure produced by springs (27), that in assembling the sleeve (7) compresses against a metal ring (28), which in turns transmits the force produced by springs deformation to the opening (24 A) by the penetration of rings protuberance (28 A). This further action improves the performance of the seal by increasing the pressure against the metallic sleeve and shaft components without much deterioration of the seal component as could be the case of an initial shape of ring (24) such that in assembling, could have a greater corresponding deformation for obtaining the same compression and equivalent seal.

The seal mechanism dictates the condition that the interface contacts (25) and (26) between ring seal (24) and metal must have a very low friction in rotation. This is achieved by providing a very low friction material in seal (24) using Teflon® seals for instance. Also in our preferred embodiment, the sealing material should be appropriate for oxygen handling as in certain cases the conduction lines in channel ring region (11, 12) will be transporting oxygen.

In the two extremes of the rotary joint apparatus the sealing mechanism is as follows:

In the extreme end, close to port (16). The channel ring is sealed by the same mechanism (23). From there to the atmosphere there is an O-ring (27) that seals the fixed plate (16A) with sleeve (7) so that no leakage passes to the atmosphere.

The other possible leakage could be through the gap between tube (19) and central shaft bore (20) after passing sleeve-shaft interface (22) and ball bearing support (32) for rotation. In such gap seal rings (21R) provide the final interruption of flow between last channel ring conduct and the central conduct line (17).

The other extreme of the rotary joint close to the trunnion end has a double packing seal (28). Between the two sealing elements in (28) there is a gap to which nitrogen gas is injected in order to provide a sealing gas for a possible leakage through the last portion of interface (29) between sleeve (7) and shaft (8).

In mounting the sleeve, screws (30) provide the necessary force to close sleeve (7) to shaft (8) working against the force produced in deformating the springs (27) as the sleeve is assembled to the shaft.

Finaly, screws (16 B) hold a plate that covers screws (30) and provides the port (16) for connecting static hose (18) for fluid or solid fines transportation. Port (31) might be used for nitrogen seal to improve isolation between ring (11, 12) and bore (20) of tube (19).

What we claim is:

1. A rotary joint apparatus for introducing and transporting several independent fluids, some including solid fines from a static system into a rotating furnace metal converter system, comprising in combination, means connecting a set of static lines to a corresponding set of ports integrated in a static sleeve of hollow cylindrical shape for receiving a plurality of separate fluids, shaft means rotating with the converter in a central axis space of the sleeve having a rotary fluid conveying shaft, a plurality of axially incorporated channels on said shaft for receiving the corresponding separate fluids from said static ports, a plurality of circumferential channels axially located along said shaft which rotate with said shaft and which transport fluids to said converter and which are directly connected to rotate with said rotating shaft and which are sealed axially from one another along said rotating shaft, and wherein said rotating shaft has a central bore passing completely through said shaft from end to end thereof along the central pivotal axis of said shaft for transporting solid fines with a carrier gas including axial sealing means between said shaft and said sleeve for sealing the separate channels axially of said rotary shaft to avoid leakage of the fluids or penetration of the solid fines therebetween.

* * * * *